US011331942B2

(12) United States Patent
Huwang

(10) Patent No.: US 11,331,942 B2
(45) Date of Patent: May 17, 2022

(54) MOLTEN GOLD WRITING APPARATUS

(71) Applicant: Quang V. Huwang, Cranford, NJ (US)

(72) Inventor: Quang V. Huwang, Cranford, NJ (US)

( * ) Notice: Subject to any disclaimer, the term of this patent is extended or adjusted under 35 U.S.C. 154(b) by 175 days.

(21) Appl. No.: 16/674,440

(22) Filed: Nov. 5, 2019

(65) Prior Publication Data

US 2021/0053383 A1 Feb. 25, 2021

Related U.S. Application Data

(60) Provisional application No. 62/889,635, filed on Aug. 21, 2019.

(51) Int. Cl.

| | |
|---|---|
| ***B43K 5/00*** | (2006.01) |
| ***B05C 17/005*** | (2006.01) |
| ***B43K 7/04*** | (2006.01) |
| ***B43K 1/08*** | (2006.01) |

(52) U.S. Cl.

CPC ..... *B43K 5/005* (2013.01); *B05C 17/00526* (2013.01); *B43K 1/082* (2013.01); *B43K 7/04* (2013.01)

(58) Field of Classification Search

CPC ..... B43K 5/005; B43K 5/03; B43K 5/14; B43K 7/005; B43K 7/02; B43K 8/003; B43K 8/03; B43K 8/20; B43K 24/06; B43K 25/022; B43K 23/002; B43K 23/001; B43K 23/126; B43K 1/082; B43K 7/04; B05C 17/00523; B05C 17/00526

See application file for complete search history.

(56) References Cited

U.S. PATENT DOCUMENTS

| | | | | | |
|---|---|---|---|---|---|
| 1,056,497 | A * | 3/1913 | Bryan | A46B 11/08 | 401/2 |
| 1,455,842 | A * | 5/1923 | Kelly | H05B 3/02 | 219/240 |
| 1,769,437 | A * | 7/1930 | Kromer, Jr. | B29B 13/022 | 401/1 |
| 2,494,412 | A * | 1/1950 | Simkins | H05B 3/02 | 401/2 |
| 2,577,721 | A * | 12/1951 | Belak | B43K 8/22 | 401/1 |
| 2,977,320 | A * | 3/1961 | Jenkins | B43K 7/00 | 427/286 |
| 4,755,490 | A * | 7/1988 | DiLazzaro | C03C 10/0045 | 501/128 |
| 4,938,923 | A * | 7/1990 | Kujiraoka | H01L 24/45 | 420/509 |
| 2004/0091302 | A1* | 5/2004 | Yokouchi | B43K 21/006 | 401/6 |
| 2007/0231053 | A1* | 10/2007 | Chan | B43K 24/06 | 401/195 |

(Continued)

*Primary Examiner* — Patrick M. Buechner

(74) *Attorney, Agent, or Firm* — The Rapacke Law Group P.A.

(57) ABSTRACT

A molten gold writing apparatus that includes a barrel extending from a top end to an open bottom end. A heating element is positioned within the barrel and includes a rechargeable battery. A cartridge includes a refillable chamber configured to hold a solid gold refill and dimensioned to fit within the heating element. The heating element melts the gold refill and allows it to flow to a tip end of the cartridge. A grip is configured to selectively engage the bottom end of the barrel to cover all but the tip end of the cartridge.

20 Claims, 4 Drawing Sheets

(56) References Cited

U.S. PATENT DOCUMENTS

| | | | | |
|---|---|---|---|---|
| 2011/0025794 | A1* | 2/2011 | Park | B41J 2/17513 347/94 |
| 2011/0081191 | A1* | 4/2011 | Monzo | B43K 29/10 401/195 |
| 2013/0142562 | A1* | 6/2013 | Briggl | B43K 21/006 401/107 |
| 2014/0154347 | A1* | 6/2014 | Dilworth | B29C 48/2528 425/87 |
| 2015/0293452 | A1* | 10/2015 | Kamins | B44D 3/22 427/256 |
| 2016/0059481 | A1* | 3/2016 | Starodubtsev | B29C 64/112 264/494 |
| 2016/0060449 | A1* | 3/2016 | Shulga | H01B 1/20 252/62.54 |
| 2017/0190118 | A1* | 7/2017 | Mire | B29C 64/393 |
| 2018/0015567 | A1* | 1/2018 | Rosso | B29C 64/209 |
| 2018/0272379 | A1* | 9/2018 | Skinner | B05C 17/00523 |
| 2020/0011477 | A1* | 1/2020 | Wartersian | A47G 21/14 |

* cited by examiner

MOLTEN GOLD WRITING APPARATUS

CROSS-REFERENCE TO RELATED APPLICATIONS

The present application claims priority to U.S. Provisional Application No. 62/889,635 filed on Aug. 21, 2019, entitled "24K Gold Ink Pen" the entire disclosure of which is incorporated by reference herein.

TECHNICAL FIELD

The embodiments relate to writing instruments, and more specifically to writing instruments having metallic ink.

BACKGROUND

Gold-toned ink pens are commonly used for calligraphy and other decorative writing and art. Those who wish to use real gold on paper are limited to gold leaf that is difficult to work with and not applicable with a writing utensil. In order to otherwise shape real gold, users are resigned to dangerous melting methods employing a blowtorch and crucible and for safer or easier methods must purchase large and expensive equipment such as a kiln or a furnace. These existing gold melting methods do not allow an easy and controlled application for writing.

The ballpoint pen is one of the most prolific writing instruments of all time and is produced by the millions daily. Traditional ballpoint pens have an ink made of dye suspended in a solvent held in a reservoir that flows through a socket to a rollerball tip where it is applied to a surface as it is written. Existing ballpoint technology would not be able to apply real gold as it would first need to be melted before being able to flow from the reservoir to the socket.

SUMMARY OF THE INVENTION

This summary is provided to introduce a variety of concepts in a simplified form that is further disclosed in the detailed description. This summary is not intended to identify key or essential inventive concepts of the claimed subject matter, nor is it intended for determining the scope of the claimed subject matter.

The present embodiments disclose a molten gold writing apparatus. The molten gold writing apparatus includes a barrel extending from a top end to an open bottom end. A heating element is positioned within the barrel and includes a rechargeable battery. A cartridge includes a refillable chamber and a tip end. The chamber is configured to hold a solid gold refill and is dimensioned to fit within the heating element. A grip is configured to selectively engage the bottom end of the barrel and is dimensioned to cover all but the tip end of the cartridge.

In one aspect, the barrel includes an upper portion twistably coupled to a lower portion. The upper portion is in operational communication with the heating element to activate and deactivate the heating element when twisted.

In one aspect, the grip includes a tubular portion and a conical portion.

In one aspect, a charging port portion of the rechargeable battery extends through the top end and is selectively in operational communication with a charger. The charging port portion may be configured to receive a standard charging cable or may have a stepped male extension dimensioned to fit within a female receiving cavity of the charger.

The rechargeable battery may alternatively be in wireless communication with the charger.

In one aspect, the heating element includes an exterior crucible shell.

In one aspect, a cap is selectively engageable with the grip to cover the tip end of the cartridge.

BRIEF DESCRIPTION OF THE DRAWINGS

A more complete understanding of the present invention and the advantages and features thereof will be more readily understood by reference to the following detailed description when considered in conjunction with the accompanying drawings wherein.

DETAILED DESCRIPTION

Figure 1:
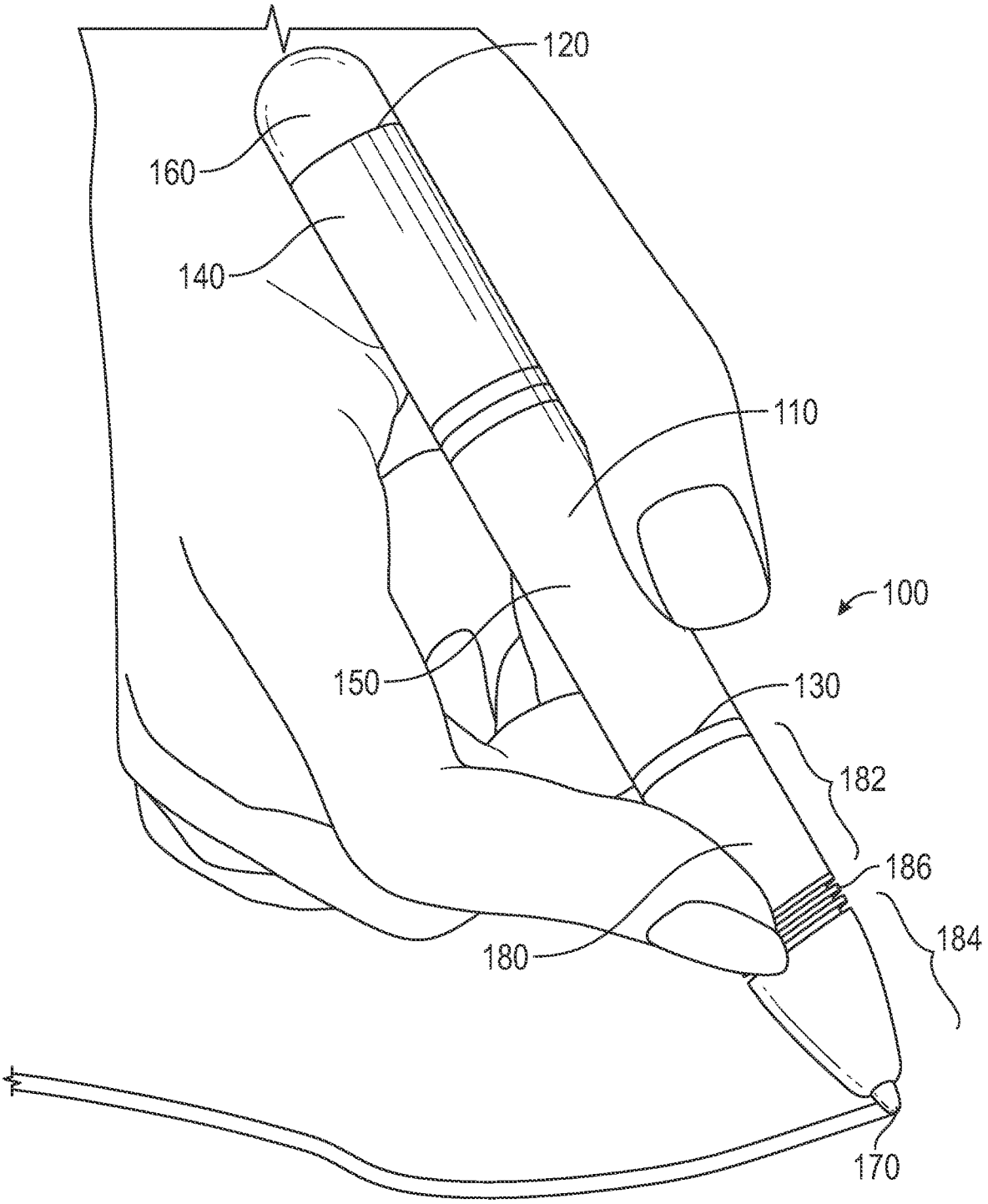
FIG. 1 illustrates an in-use view of a molten gold writing apparatus, according to some embodiments.

The specific details of the single embodiment or variety of embodiments described herein are to a system and method of use. Any specific details of the embodiments are used for demonstration purposes only and no unnecessary limitations or inferences are to be understood therefrom.

Before describing in detail exemplary embodiments, it is noted that the embodiments reside primarily in combinations of components related to the system and method. Accordingly, the system components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, relational terms, such as "first" and "second", "top" and bottom", and the like, may be used solely to distinguish one entity or element from another entity or element without necessarily requiring or implying any physical or logical relationship or order between such entities or elements.

Figure 2:
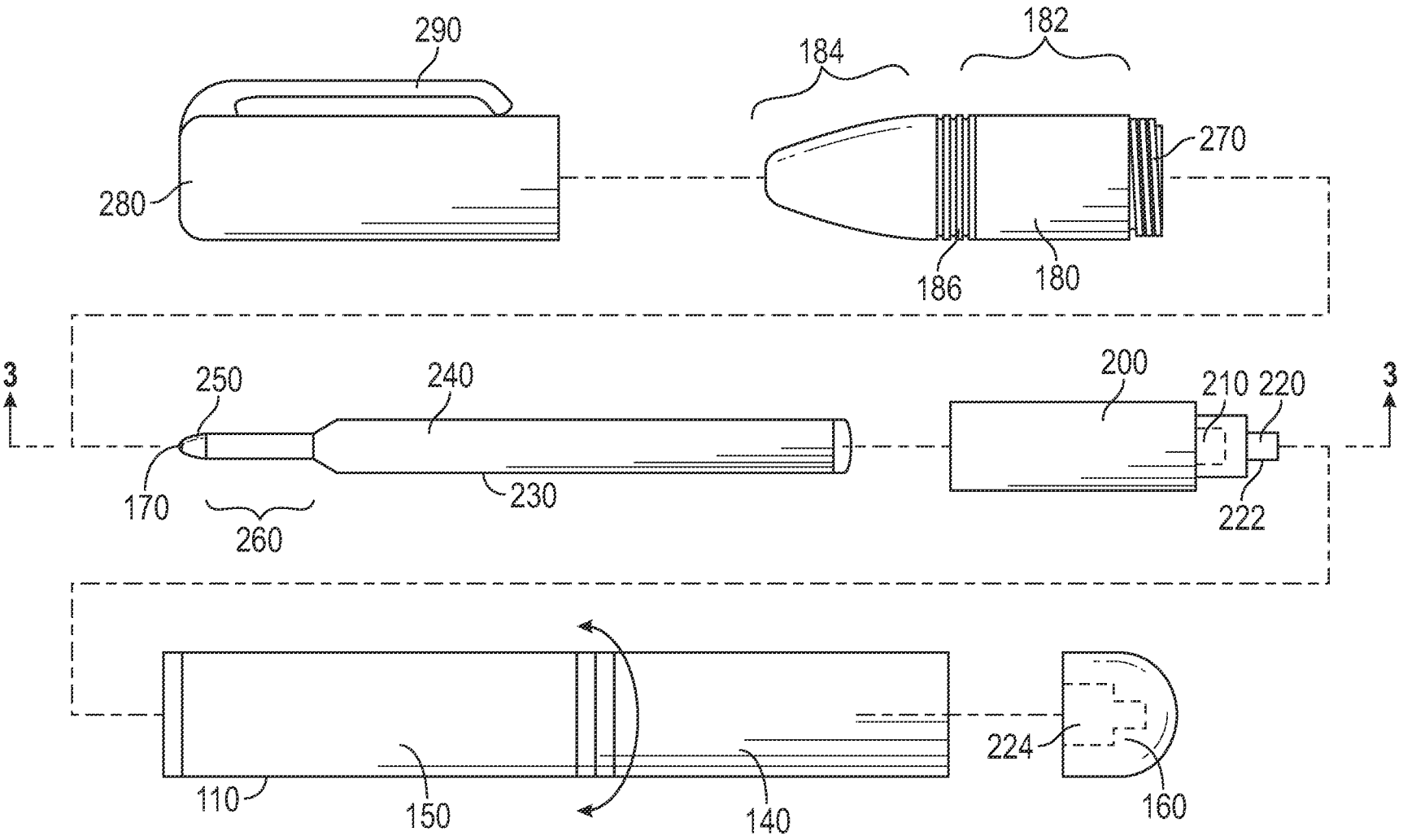
FIG. 2 illustrates an exploded view of the molten gold writing apparatus, according to some embodiments.

Embodiments presented herein relate to a molten gold writing apparatus 100 illustrated in FIG. 1 including a barrel 110 extending from a top end 120 to an open bottom end 130. The barrel 110 may include an upper portion 140 twistably coupled to a lower portion 150. As illustrated in FIG. 2, a heating element 200 includes a rechargeable battery 210. The heating element 200 may be tubular and is configured to be positioned within the barrel 110.

In some embodiments, the upper portion 140 of the barrel is in operational communication with the heating element 200 to activate and deactivate the heating element 200 when twisted. The heating element 200 may alternatively have a power switch extending through the barrel 110.

Figure 3:
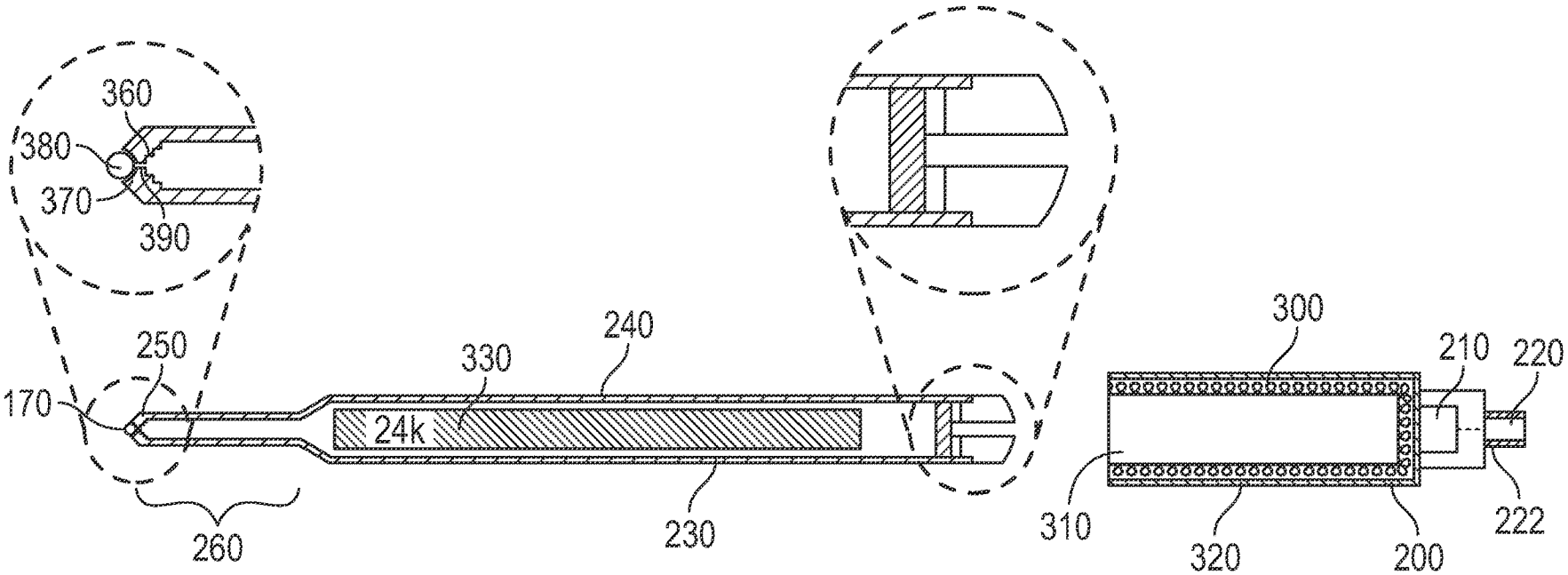
FIG. 3 illustrates a cross-sectional view of the cartridge and the heating element from FIG. 2, according to some embodiments.

In some embodiments, the heating element 200 may have a plurality of internal resistors 300 surrounding a heating element cavity 310 shown in FIG. 3.

In some embodiments, the heating element 200 includes an exterior crucible shell 320. The exterior crucible shell 320 may be graphite carbon or another highly temperatureresistant material such as clay and the like to prevent the heating element 200 from melting the barrel 110.

In some embodiments, the rechargeable battery 210 has a charging port portion 220 extending through the top end 120. The charging port portion 220 is selectively in operational communication with a charger 400.

In some embodiments, the charging port portion 220 of the rechargeable battery has a stepped male extension 222 dimensioned to fit within a female receiving cavity 410 of the charger. The charging port portion 220 may alternatively be recessed within the top end 120 and is configured to receive a standard charging cable such as a USB.

In some embodiments a top cover 160 is configured to selectively engage the top end 120 of the barrel. The top cover 160 includes a cover cavity 224 dimensioned to receive the stepped male extension 222.

Figure 4:
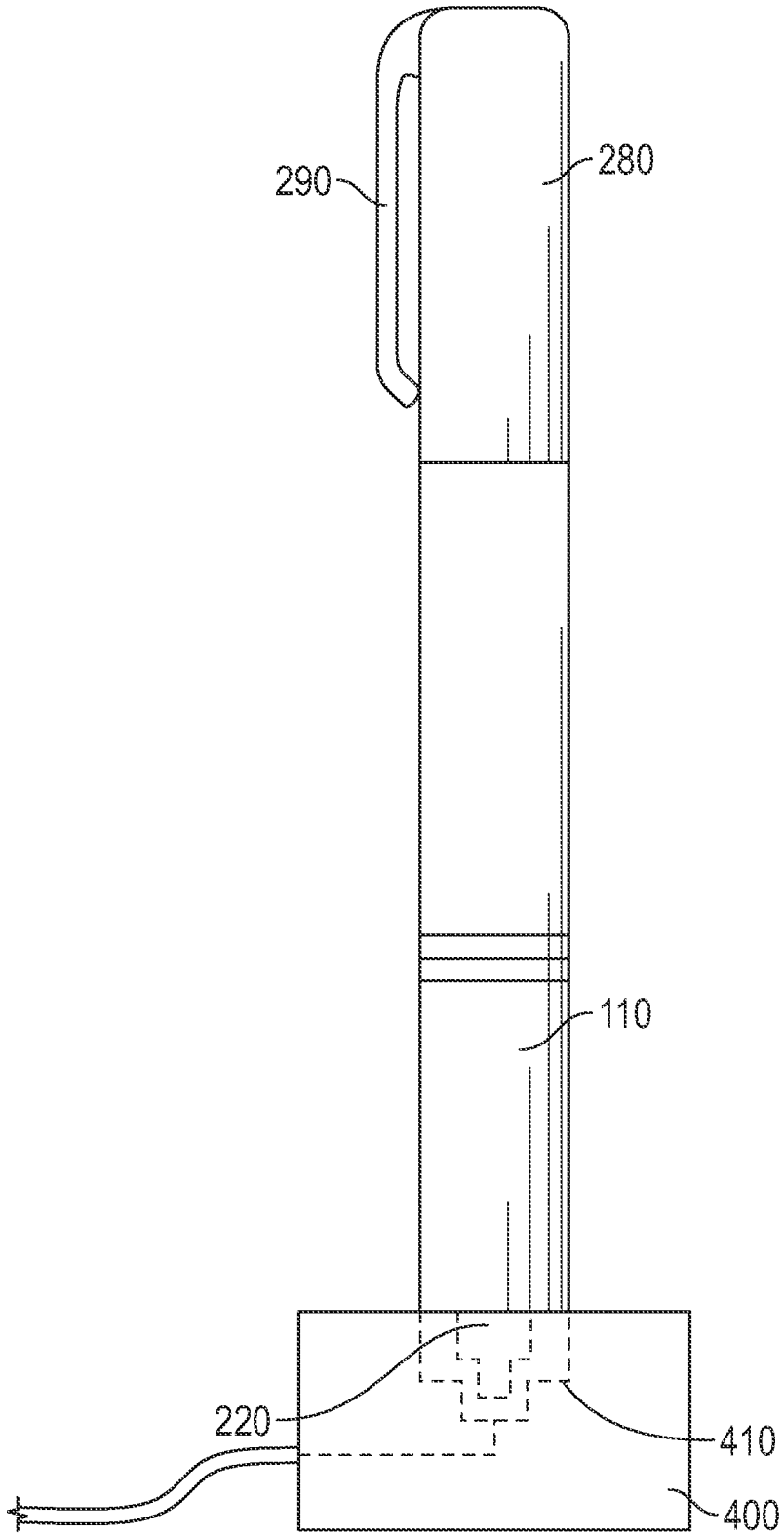
FIG. 4 illustrates a side view the molten gold writing apparatus and the charger, according to some embodiments.

In some embodiments, the charger 400 supports the barrel 110 and all attached elements in a vertical position as seen in FIG. 4.

In some embodiments, the rechargeable battery 210 is in wireless communication with the charger 400.

A cartridge 230 includes a refillable chamber 240 and a tip end 250. The chamber 240 may include an extension portion 260 extending to a ballpoint tip 170 of the tip end. The chamber 240 is configured to hold a solid gold refill 330 and is dimensioned to fit within the heating element cavity 310. The gold refill 330 may be offered in 24 karat gold or may have an additive to lower the melting point of the refill 330. Upon activation, the heating element 200 melts the gold refill 330 within the chamber 240 and flows the molten gold refill 330 through the extension portion 260 to the ballpoint tip 170 for application on a surface. The user may thus write or draw in pure gold to achieve a pinnacle of style and elegance. The cartridge 230 may be offered in a versions with the ballpoint tip 170 having different diameters to write fine, medium, and bold lines.

A grip 180 is configured to selectively engage the bottom end 130 of the barrel and dimensioned to cover all but the tip end 250 of the cartridge. The grip 180 prevents the user from directly contacting any portion of the cartridge 230 that may be hot. The grip 180 may engage the barrel 110 with a press fit or with a first threaded portion 270.

In some embodiments, the grip 180 includes a tubular portion 182 and a conical portion 184.

In some embodiments a cap 280 is selectively engageable with the grip 180 to cover the tip end 250 of the cartridge. The cap 280 may fully cover the conical portion 184 and may engage the grip 180 with a press fit or with a second threaded portion 186 of the grip. The cap 280 may have a clip 290 to attach the apparatus 100 to an article of clothing and to prevent the apparatus 100 from rolling off of a table.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A molten gold writing apparatus, the molten gold writing apparatus comprising:

a barrel extending from a top end to an open bottom end;

a heating element positioned within the barrel, the heating element including a rechargeable battery;

a cartridge including a refillable chamber and a tip end, the refillable chamber being configured to hold a solid gold refill and dimensioned to fit within the heating element; and a grip configured to selectively engage the bottom end of the barrel and dimensioned to cover all but the tip end of the cartridge.

2. The molten gold writing apparatus of claim 1, wherein the barrel includes an upper portion twistably coupled to a lower portion, the upper portion being in operational communication with the heating element to activate and deactivate the heating element when twisted.

3. The molten gold writing apparatus of claim 1, wherein the grip includes a tubular portion and a conical portion.

4. The molten gold writing apparatus of claim 1, wherein a charging port portion of the rechargeable battery extends through the top end and is selectively in operational communication with a charger.

5. The molten gold writing apparatus of claim 4, wherein the battery is in wireless communication with the charger.

6. The molten gold writing apparatus of claim 1, wherein the heating element includes an exterior crucible shell.

7. The molten gold writing apparatus of claim 1, further comprising a cap, the cap being selectively engageable with the grip to cover the tip end of the cartridge.

8. A molten gold writing apparatus, the molten gold writing apparatus comprising:

a barrel extending from a top end to an open bottom end;

a heating element positioned within the barrel, the heating element including a rechargeable battery, the rechargeable battery having a charging port portion extending through the top end and being selectively in operational communication with a charger;

a cartridge including a refillable chamber and a tip end, the chamber being configured to hold a solid gold refill and dimensioned to fit within the heating element; and a grip configured to selectively engage the bottom end of the barrel and dimensioned to cover all but the tip end of the cartridge.

9. The molten gold writing apparatus of claim 8, wherein the barrel includes an upper portion twistably coupled to a lower portion, the upper portion being in operational communication with the heating element to activate and deactivate the heating element when twisted.

10. The molten gold writing apparatus of claim 8, wherein the grip includes a tubular portion and a conical portion.

11. The molten gold writing apparatus of claim 8, wherein the heating element includes an exterior crucible shell.

12. The molten gold writing apparatus of claim 8, further comprising a cap, the cap being selectively engageable with the grip to cover the tip end of the cartridge.

13. The molten gold writing apparatus of claim 8, wherein the charging port portion of the rechargeable battery has a stepped male extension dimensioned to fit within a female receiving cavity of the charger.

14. The molten gold writing apparatus of claim 13, wherein the charger supports the barrel and all attached elements in a vertical position.

15. The molten gold writing apparatus of claim 13, further comprising a top cover configured to selectively engage the top end of the barrel, the top cover including a cover cavity dimensioned to receive the stepped male extension.

16. A molten gold writing apparatus, the molten gold writing apparatus comprising:

a barrel extending from a top end to an open bottom end, the barrel including an upper portion twistably coupled to a lower portion;

a heating element positioned within the barrel, the heating element including an exterior crucible shell and a rechargeable battery, the rechargeable battery having a charging port portion extending through the top end and being selectively in operational communication with a charger, the upper portion of the barrel being in operational communication with the heating element to activate and deactivate the heating element when twisted;

a cartridge including a refillable chamber and a tip end, the chamber being configured to hold a solid gold refill and dimensioned to fit within the heating element;

a grip configured to selectively engage the bottom end of the barrel and dimensioned to cover all but the tip end of the cartridge; and a cap, the cap being selectively engageable with the grip to cover the tip end of the cartridge.

17. The molten gold writing apparatus of claim 16, wherein the grip includes a tubular portion and a conical portion.

18. The molten gold writing apparatus of claim 16, wherein the charging port portion of the rechargeable battery has a stepped male extension dimensioned to fit within a female receiving cavity of the charger.

19. The molten gold writing apparatus of claim 18, wherein the charger supports the barrel and all attached elements in a vertical position.

20. The molten gold writing apparatus of claim 18, further comprising a top cover configured to selectively engage the top end of the barrel, the top cover including a cover cavity dimensioned to receive the stepped male extension.

* * * * *